US005172089A

United States Patent [19]

Wright et al.

[11] Patent Number: 5,172,089

[45] Date of Patent: Dec. 15, 1992

[54] POOL PUMP FAIL SAFE SWITCH

[76] Inventors: Jane F. Wright; Robert G. Wright, both of 3844 Deerrun La., Harvey, La. 70058-2121

[21] Appl. No.: 715,473

[22] Filed: Jun. 14, 1991

[51] Int. Cl.[5] ..... H01H 9/00

[52] U.S. Cl. ..... 335/205; 200/81.9 M

[58] Field of Search ..... 307/118; 200/81.9 M, 200/84; 335/205-207

[56] References Cited

U.S. PATENT DOCUMENTS

| | | | |
|---|---|---|---|
| 3,549,839 | 12/1970 | Hill | 200/81.9 M |
| 4,047,048 | 9/1977 | Demido | 200/81.9 M |
| 4,057,700 | 11/1977 | Nakashima | 200/84 C |
| 4,074,095 | 2/1978 | Romanowski | 200/81.9 M |
| 4,265,598 | 5/1981 | Brand | 200/84 R |
| 4,361,274 | 11/1982 | Raleigh et al. | 236/21 B |
| 4,499,347 | 2/1985 | Richards | 200/81.9 M |

*Primary Examiner*—Lincoln Donovan

[57] ABSTRACT

A fluid detection device designed to detect the presence of fluids in a flowing or non-flowing state and having the ability to energize or de-energize large current devices such as a swimming pool pump motor. It is equipped with a fluid detector tube designed to be mounted to a vertical fluid carrying conduit such as an intake to a pump. The fluid detector tube has an internal float with permanent magnet and a normally open magnetic reed switch mounted to its exterior. The float with permanent magnet at its highest vertical position closes the magnetic reed switch's contacts and activates a phase shift network. The current through the reed switch is less than fifteen millamps. The phase shift network forward biases a diac which in turn forward biases a traic. The traic completes the connection from a power source to a large current device. The de-energize state of the traic is stabilized by a snubber network. The energize state of the traic is stabilized by the phase shift network and diac. Which permits the voltage drop across the traic main terminals to be less than 1.5 vac when operating a large current device at 15 amperes and 120 vac.

1 Claim, 1 Drawing Sheet

POOL PUMP FAIL SAFE SWITCH

SUMMARY OF THE INVENTION

Figure 1:
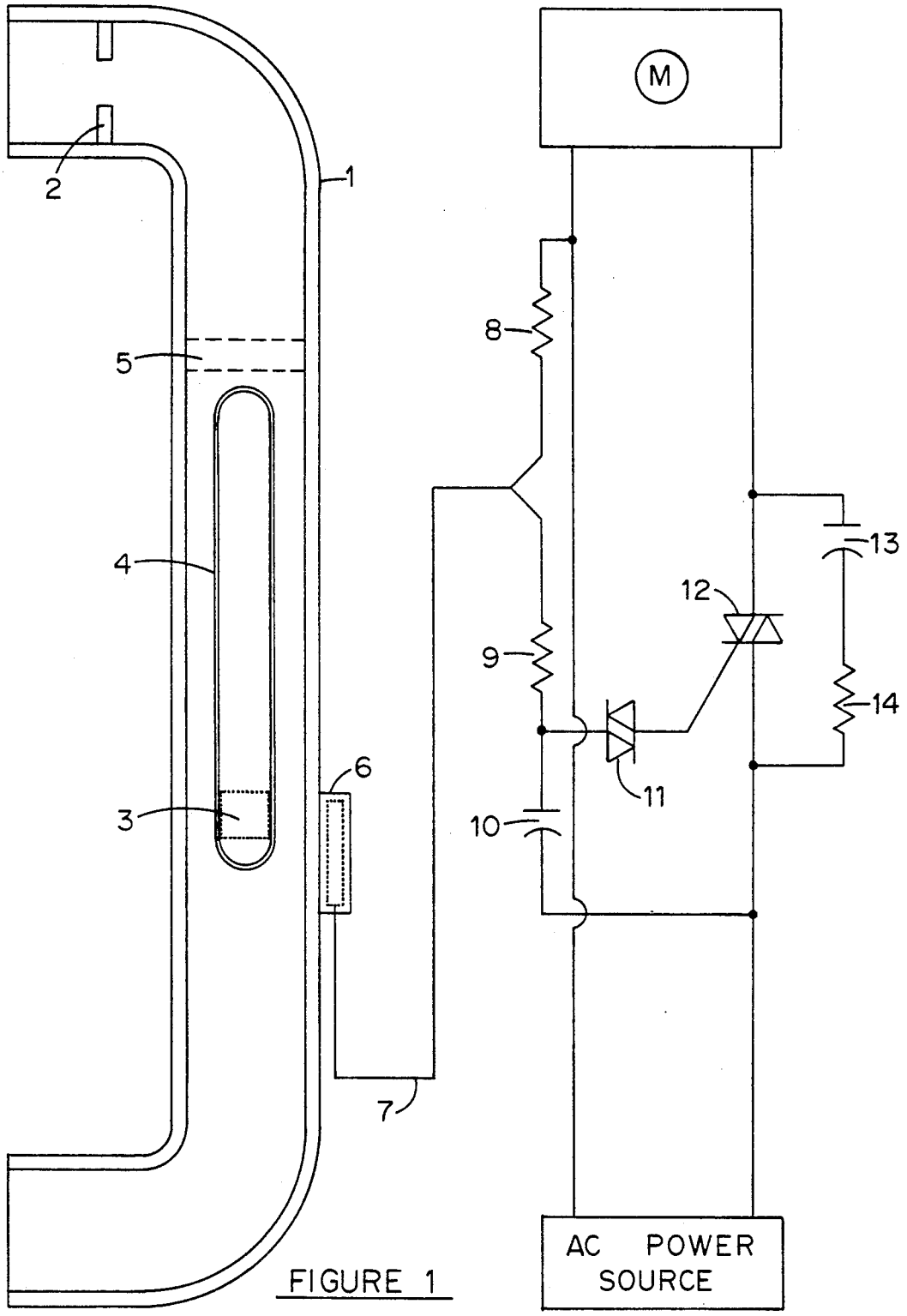

The present invention is designed to provide an inexpensive switch/monitor to detect the presents of fluids such as water in a flowing or non-flowing state.

It is also the objective of the invention to provide a switch/monitor that can de-energize a pump motor, such as a swimming pool pump motor if fluids are not present without the use of external circuits such as relays, transformer ect.

It is also the object of the present invention to provide a switch/monitor that can be installed on existing or new systems and have no electrical componets in or near the fluids surface.

It accomplishes this with a fluid detection tube with an internal float with permanent magnet and a external magnetic reed switch mounted on the exterior surface of the fluid detection tube. The magnetic reed switch is connected to a solid state switch by a two conductor cord.

The fluid detector tube is connected to a vertical fluid carrying conduit in a parallel manner. Fluid enters the lower intake of the fluid detector tube. As fluids rise, and trapped gases such as air, escapes out of the upper fluid control valve. The internal float with permanent magnet, rises until contact is made with the float stop. This brings the permanent magnet within switch means of a (normally open) magnetic reed switch. The magnetic reed switch closes and activates the phase shift network. The phase shift network provides a 50 degree lead voltage phase shift. When the source voltage (which is alternating current) begins the negative or positive half cycle, the voltage across the terminals of the diac, (one of its terminals is connected to the phase shift network and the other terminal to the gate of the traic) is 30 vac. The traic is forward bias this connects the source voltage to the pump motor, such as a swimming pool pump motor. When fluids are not present in the fluid carrying conduit. The fluids in the fluid detector tube is displaced by gases such as air, which enters from the upper intake which is connected to the fluid carrying conduit. The float falls, the phase shift network is de-activated, the traic is reversed bias, and the pump motor is de-energized. At this point any voltage induced by the load is bypassed around the traic through the snubber network to avoid false triggering.

DRAWINGS

FIG. 1*a* is a front view of the fluid detector tube and a schematic of the static switch.

DESCRIPTION OF PERFERRED EMBODIMENT

Referring to drawings. FIG. 1*a* drawings. 1 is the fluid detector tube, it is a conduit or pipe with a 90 degree elbow at both ends composed of Polyvinylchoride or a like material. 2 is the control valve, a disk with the diameter equal to the inside diameter of the intake of the fluid detector tube. The control valve has a orfice, the orfice purges gases in the fluid detector tube when fluids are first introduced and reintroduced. It also controls the amount of fluids entering the fluid detector tube, if the fluids being detected is flowing. The control valve provides a screening action to prevent solid particals too large to saftely pass through the fluid detector tube from entering. The control valve is composed of Polyvinylchoride or a like material. 3 is a permanent magnet which is incased inside of the. 4 float tube, a tubular pipe with both ends sealed composed of Polyvinylchoride or a like material, with an outside diameter slighty less than the inside diameter of the fluid detector tube. 5 is a float stop that limits the upward movement of the float which brings the permanent magnet within switch means of the. 6 magnetic reed switch (normally open) which is sealed in a tube composed of Polyvinylchoride or a like material and sealed with a epoxy or a suitable insulated material, the magnetic reed switch is mounted on the exterior surface of the fluid detector tube with contact cement. The magnetic reed switch is connected to a. 7 two conductor cord which is connected to the 8 and 9 resistors of the phase shift network. 8, 9 and 10 resistors and capacitor composed the phase shift network, which provides a 50 degree lead voltage phase shift in relation to the incoming commerical power. The 11 diac provides a voltage pulse when the voltage difference cross the terminals of the diac is 30 VDC or greater the diac is forward bias. The voltage pulse is felt at the gate of the. 12 triac, the forward bias traic will complete the circuit between the pump motor such as a swimming pool pump motor or any other equipement and commerical power. The 13 and 14 resistor and capacitor is a conventional Resistor/-Capacitor snubber network connected across the two terminals of the triac. The snubber network prevents the induced voltage from the pump motor from effecting the triac.

We claim;

1. A fluid detector device having;

A fluid detector tube being a tubular member, having 90 degree bends forming intake and outtake apertures on each of said fluid detector tube said fluid detector tube having;

a control valve mounted to the intake of said fluid detector tube;

a float stop mounted in the upperhalf of said detector tube;

a tubular float fitting loosely inside of said fluid detector tube;

said float having a permanent magnet incased within;

a normally open magnetic reed switch encased in epoxy and attached to said fluid detector tube a two conductor cord connecting said magnetic reed switch to a control unit;

said control unit providing a static switch connection between an electrical power source and a pump motor comprising;

said phase shift network;

said two conductor cord connecting the phase shift network and said magnetic reed switch;

said phase shift network connected to two terminals of a traic and one terminal of a diac; said traic connected in series with the electrical power source and pump motor;

said diac connected to the gate of said traic; and a resistor/capacitor snubber network connected across said terminal of said traic.

* * * * *

UNITED STATES PATENT AND TRADEMARK OFFICE

CERTIFICATE OF CORRECTION

PATENT NO. : 5,172,089

DATED : 12-15-92

INVENTOR(S) : Jane F. Wright et al

It is certified that error appears in the above-indentified patent and that said Letters Patent is hereby corrected as shown below:

On the Title page,
Title of Invention Item (54), "Pool Pump Fail Safe Switch" should read -- Fluid Detection Device --.

Inventors address, "both of 3844 Deerun La., Harvey La." should read -- both of 3844 Deerun, ln, Harvey La. --.

Signed and Sealed this

Ninth Day of November, 1993

Bruce Lehman

*Attest:*

BRUCE LEHMAN

*Attesting Officer*

*Commissioner of Patents and Trademarks*